US008397648B1

(12) United States Patent
Palladino

(10) Patent No.: US 8,397,648 B1
(45) Date of Patent: Mar. 19, 2013

(54) PORTABLE TABLE SYSTEM

(76) Inventor: Michael J. Palladino, Newport Beach, CA (US)

( * ) Notice: Subject to any disclaimer, the term of this patent is extended or adjusted under 35 U.S.C. 154(b) by 43 days.

(21) Appl. No.: 13/094,951

(22) Filed: Apr. 27, 2011

Related U.S. Application Data

(60) Provisional application No. 61/330,662, filed on May 3, 2010.

(51) Int. Cl.
*A47B 23/00* (2006.01)

(52) U.S. Cl. ..... 108/42; 108/50.12

(58) Field of Classification Search ..... 108/42, 108/152, 50.12; 211/107, 86.01, 90.01, 88.01, 211/119.003
See application file for complete search history.

(56) References Cited

U.S. PATENT DOCUMENTS

| | | | | |
|---|---|---|---|---|
| 475,149 | A * | 5/1892 | Pearson | 211/107 |
| 2,743,146 | A * | 4/1956 | Wheeler | 108/50.12 |
| 2,799,543 | A * | 7/1957 | Tomaselli | 108/50.12 |
| 3,620,174 | A * | 11/1971 | Dentino | 108/152 |
| 5,161,561 | A * | 11/1992 | Jamieson | 135/16 |
| 5,294,012 | A * | 3/1994 | Shott et al. | 220/23.4 |
| 6,474,244 | B1 * | 11/2002 | Karpinski | 108/42 |
| 6,477,966 | B1 * | 11/2002 | Petryna | 108/11 |
| 6,837,386 | B1 * | 1/2005 | Kent et al. | 108/50.12 |
| 6,883,673 | B1 * | 4/2005 | Gourley | 108/94 |
| 6,889,618 | B1 * | 5/2005 | Gromack | 108/151 |
| 8,136,458 | B1 * | 3/2012 | Cass et al. | 108/50.12 |
| 2007/0246091 | A1 * | 10/2007 | Becker | 108/50.12 |
| 2011/0113990 | A1 * | 5/2011 | Wald | 108/42 |

* cited by examiner

*Primary Examiner* — Jose V Chen
(74) *Attorney, Agent, or Firm* — Tran & Associates

(57) ABSTRACT

A portable table system detachably secured upon various supporting members, such as vertical or angled columns or trees and horizontal rails. The system includes a tabletop having a first and second section each with a cutout for receiving the vertical or angled support member, first and second hook members extending from the underside of the tabletop, and a clamping assembly for being attached to the support member and being coupled to the tabletop via the hook members. Latching assemblies are used to attach the first and second sections together. Fillers may be used to partially fill the cutouts such as when the support member is relatively small or to completely fill the cutouts such as when attached to a horizontal support member. The clamping assembly may include a structure suitable for receiving flat-sided, rounded, or irregular-shaped support members. An optional legged-base assembly may also be used as the support member.

18 Claims, 17 Drawing Sheets

PORTABLE TABLE SYSTEM

CROSS REFERENCE TO RELATED APPLICATIONS

I hereby claim benefit under Title 35, United States Code, Section 119(e) of U.S. provisional patent application Ser. No. 61/330,662 filed May 3, 2010. The 61/330,662 application is currently pending. The 61/330,662 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a table and more specifically it relates to a portable table system for efficiently and detachably securing a tabletop upon various supporting structures, such as vertical and horizontal columns.

2. Description of the Related Art

Any discussion of the related art throughout the specification should in no way be considered as an admission that such related art is widely known or forms part of common general knowledge in the field.

Many types of tables are used for a variety of different applications. It is often desired to have a tabletop that may be movable to different locations, as well as being sturdy. Standard portable tables, such as but not limited to folding tables, provide for portability; however the tables are often not stable and also generally require a sufficient amount of ground space and a level ground surface.

Further, there are often supporting columns within rooms or different areas of a home which would prevent placement of prior art furniture such as tables in those locations. By providing a portable table which may be securely attached to such a column, individuals will have more flexibility when positioning furniture in their home or other areas. By utilizing the present invention, furniture such as tables may be positioned in areas which previously would have been inaccessible.

Because of the inherent problems with the related art, there is a need for a new and improved portable table system for efficiently and detachably securing a tabletop upon various supporting structures, such as vertical and horizontal columns.

BRIEF SUMMARY OF THE INVENTION

A system for efficiently and detachably securing a tabletop upon various supporting structures, such as vertical and horizontal columns. The invention generally relates to a portable table which includes a tabletop having a first and second section each with a cutout for receiving the vertical or angled support member, first and second hook members extending from the underside of the tabletop, and a clamping assembly for being attached to the support member and being coupled to the tabletop via the hook members. Latching assemblies are used to attach the first and second sections together. Fillers may be used to partially fill the cutouts such as when the support member is relatively small or to completely fill the cutouts such as when attached to a horizontal support member. The clamping assembly may include a structure suitable for receiving flat-sided, rounded, or irregular-shaped support members. An optional legged-base assembly may also be used as the support member.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
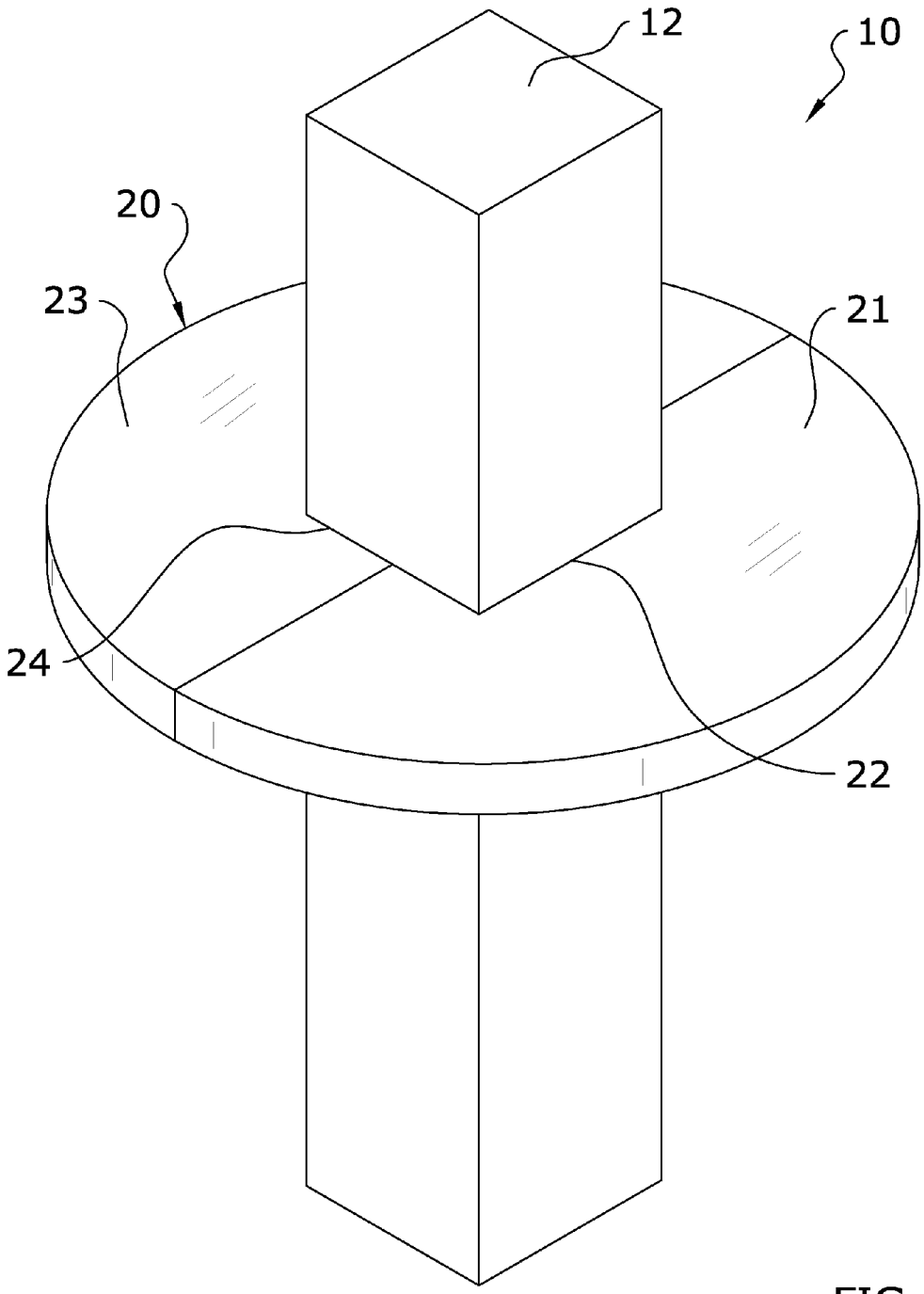
FIG. 1 is an upper perspective view of the present invention attached to a vertical support member.

A. Overview.

Turning now descriptively to the drawings, in which similar reference characters denote similar elements throughout the several views, FIGS. 1 through 17 illustrate a portable table system 10, which comprises a tabletop 20 having a first and second section 21, 23 each with a cutout 22, 24 for receiving the vertical or angled support member 12, 13, 87 first and second hook members 45 extending from the underside of the tabletop 20, and a clamping assembly 50 for being attached to the support member 12-14, 87 and being coupled to the tabletop 20 via the hook members 40, 45. Latching assemblies 26 are used to attach the first and second sections 21, 23 together. Filler members 30 may be used to partially fill the cutouts 22, 24 such as when the support member 12, 13 is relatively small or to completely fill the cutouts 22, 24 such as when attached to a horizontal support member 14 or the table support member 87. The clamping assembly 50 may include a structure suitable for receiving flat-sided, rounded, or irregular-shaped support members 12, 13. An optional legged-base assembly 80 may also be used as the support member 87.

A primary feature of the system 10 is to be able to turn unusable space, such as space along a vertical, angled, or horizontal support member to usable space. The system 10 may be used indoors or outdoors, such as in homes, condos or apartment patios, indoor and outdoor shopping malls, hotels, resorts, parks and anywhere else a table is needed on either a temporary or semi-permanent basis. The system 10 may be used on nearly any vertical natural or man-made structure from a tree to an outdoor heater to a patio cover or balcony column, fence, balcony rail, or attached to a base assembly having legs. The system 10 is weather resistant, stainable and paintable to match specific décor or preference. In addition to the vertical poles, angled poles, vertical columns, fence rail, balcony rail, indoor column, etc., any other vertical support members, angled support members, or horizontal support members may be used to support the system 10 as appreciated. The tabletop 20 may be positioned low to the ground to display plants or for a great child's play table, be installed higher to use as a side table next to chairs, or even higher for use as a cocktail table, among many other uses.

B. Tabletop Assembly.

The present invention includes a tabletop generally comprising a tabletop 20 and hook members 40, 45 extending therefrom to couple the tabletop 20 to a clamp assembly 50. The tabletop 20 is generally formed from a first section 21 and a second section 23, wherein the first section 21 and the second section 23 each comprise half of the tabletop 20, such as each being a semi-circle to form a complete circular tabletop 20 as illustrated in at least FIGS. 1 and 2 or each being a rectangular-halve to form a square or rectangular tabletop 20. It is appreciated that the first section 21 and second section 23 of the tabletop 20 will preferably mirror each other's structures, though in some embodiments alternative configurations may be utilized. The tabletop 20, filler members 30, 35, and hook members 40, 45 may be comprised of various materials, such as but not limited to wood or other decorative and strong material. It is also appreciated that various table skirts may be draped over the tabletop 20.

Figure 9:
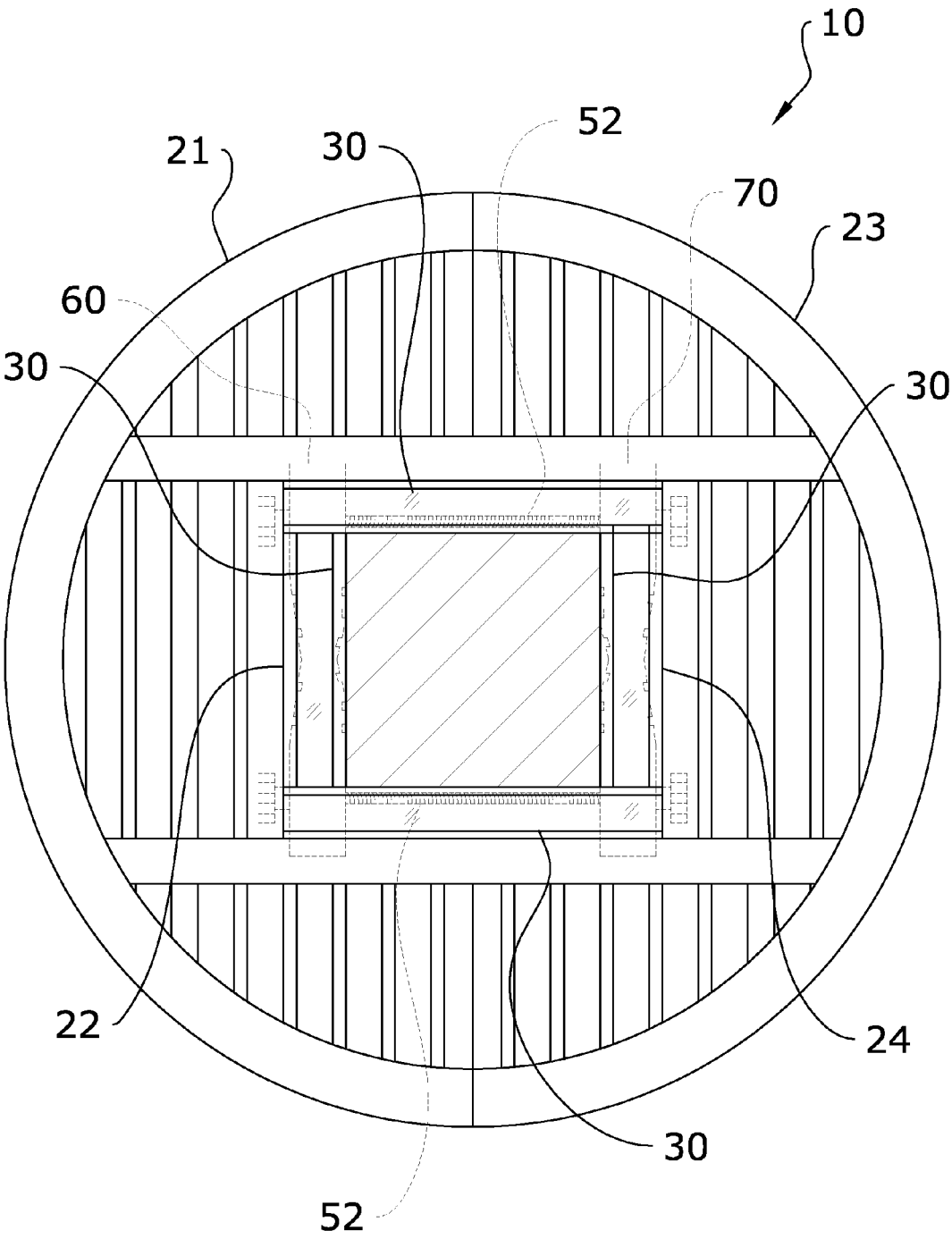
FIG. 9 is a top view of the present invention attached to a vertical support member having a cross-sectional area less than the cross-sectional area of the cutouts and showing four slatted-filler members being used.
Figure 10:
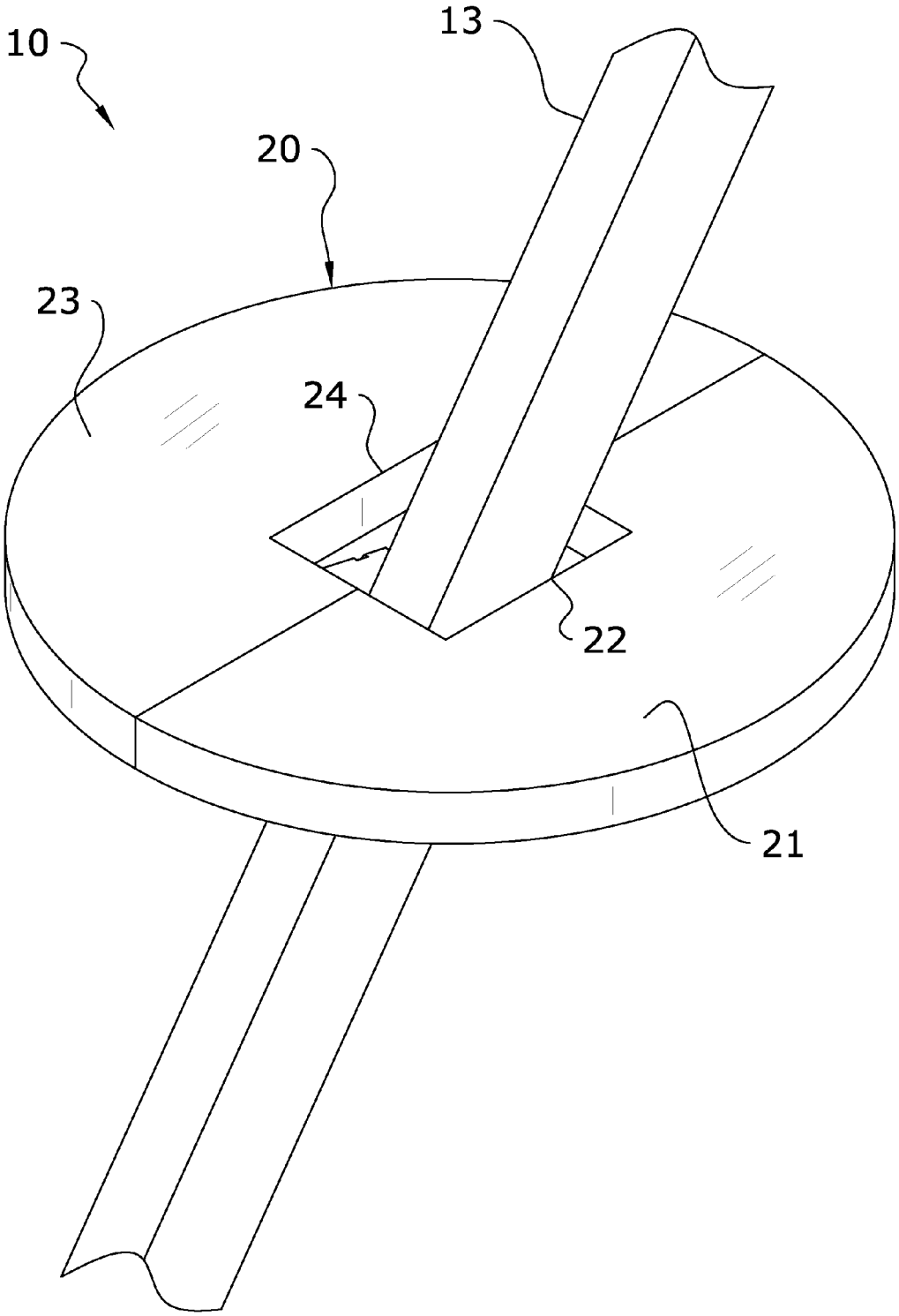
FIG. 10 is an upper perspective view of the present invention attached to an angled support member.

The tabletop 20 is also generally oriented within a horizontal plane such that upper and lower surfaces of the tabletop 20 are horizontal. The tabletop 20 may further comprise a smooth, continuous upper and/or lower surface as illustrated in at least FIGS. 1 and 2, or may have a structure including a plurality of spaced-apart slats or members as illustrated in FIG. 9. It is appreciated that the different embodiments illustrated and/or described may be interchanged as desired.

The first section 21 and the second section 23 generally mirror each other and are attachable around the clamp assembly 50 and also generally around various vertical support members 12 or angled support members 13 such as to radiate outwardly therefrom around the entire perimeter of the vertical support members 12 or angled support members 13. The first section 21 also generally includes a first cutout 22 and a second cutout 24. Each cutout 22, 24 is generally rectangular; however semi-circular cutouts may be desired, as long as the formed shape of the first cutout 22 and the second cutout 24 match the shape of the various vertical support members 12 or angled support members 13.

The size of the cutout 22, 24 may also vary. In the preferred embodiment, the first cutout 22 and the second cutout 24 may be filled with various filler members 30 or a filler unit 35 to partially fill or completely fill the common space or open area formed by the cutouts 22, 24. For example, the formed open area defined by the cutouts 22, 24 is approximately 6 inches×6 inches, though the present application should not be construed as being limited to such dimensions. If the vertical support member 12 or the angled support member 13 fills the entire open area defined by the cutout 22, 24, no filler members 30, 35 are needed as illustrated in FIG. 1.

Figure 6:
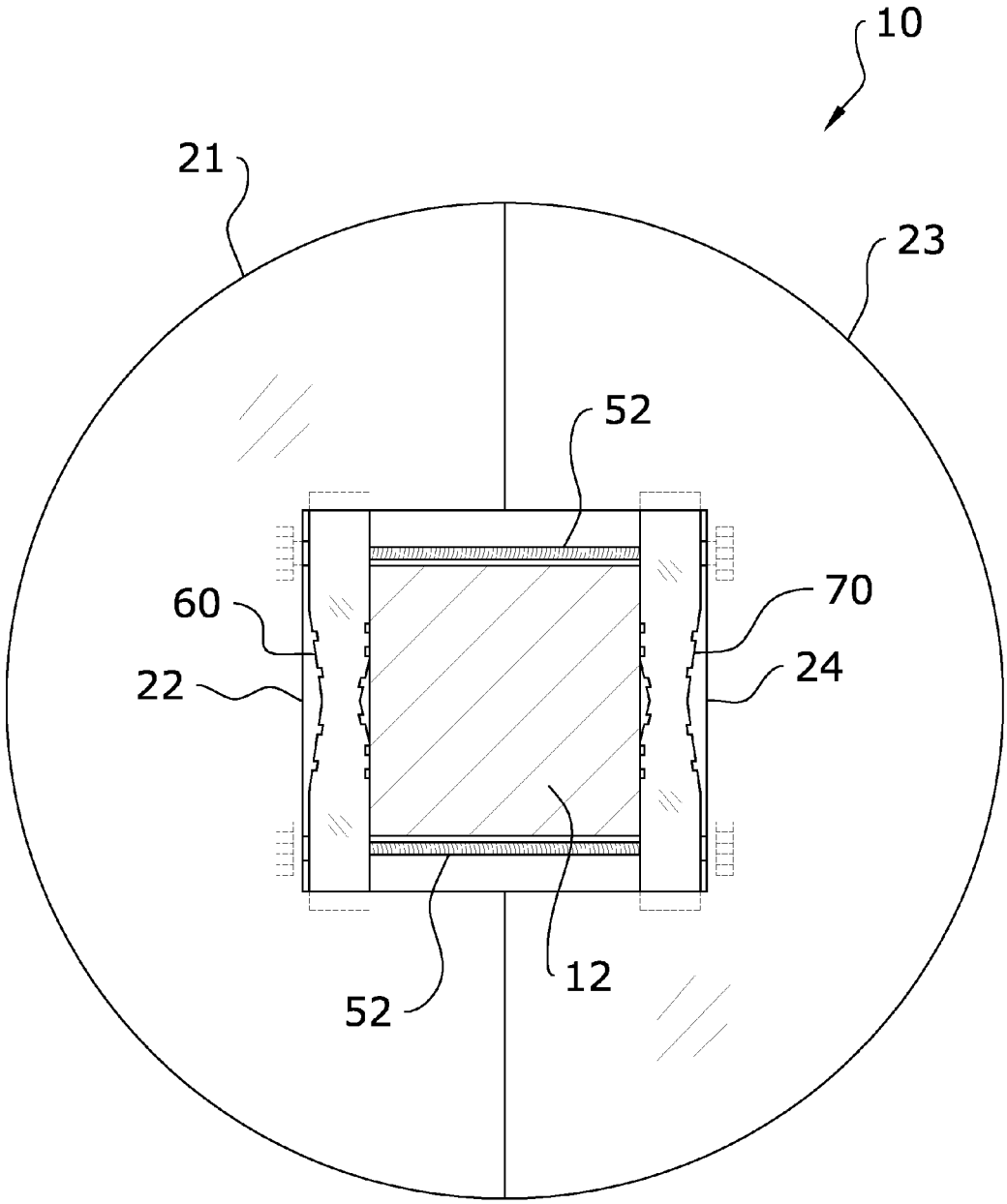
FIG. 6 is a top view of the present invention attached to a vertical support member having a cross-sectional area less than the cross-sectional area of the cutouts.
Figure 7:
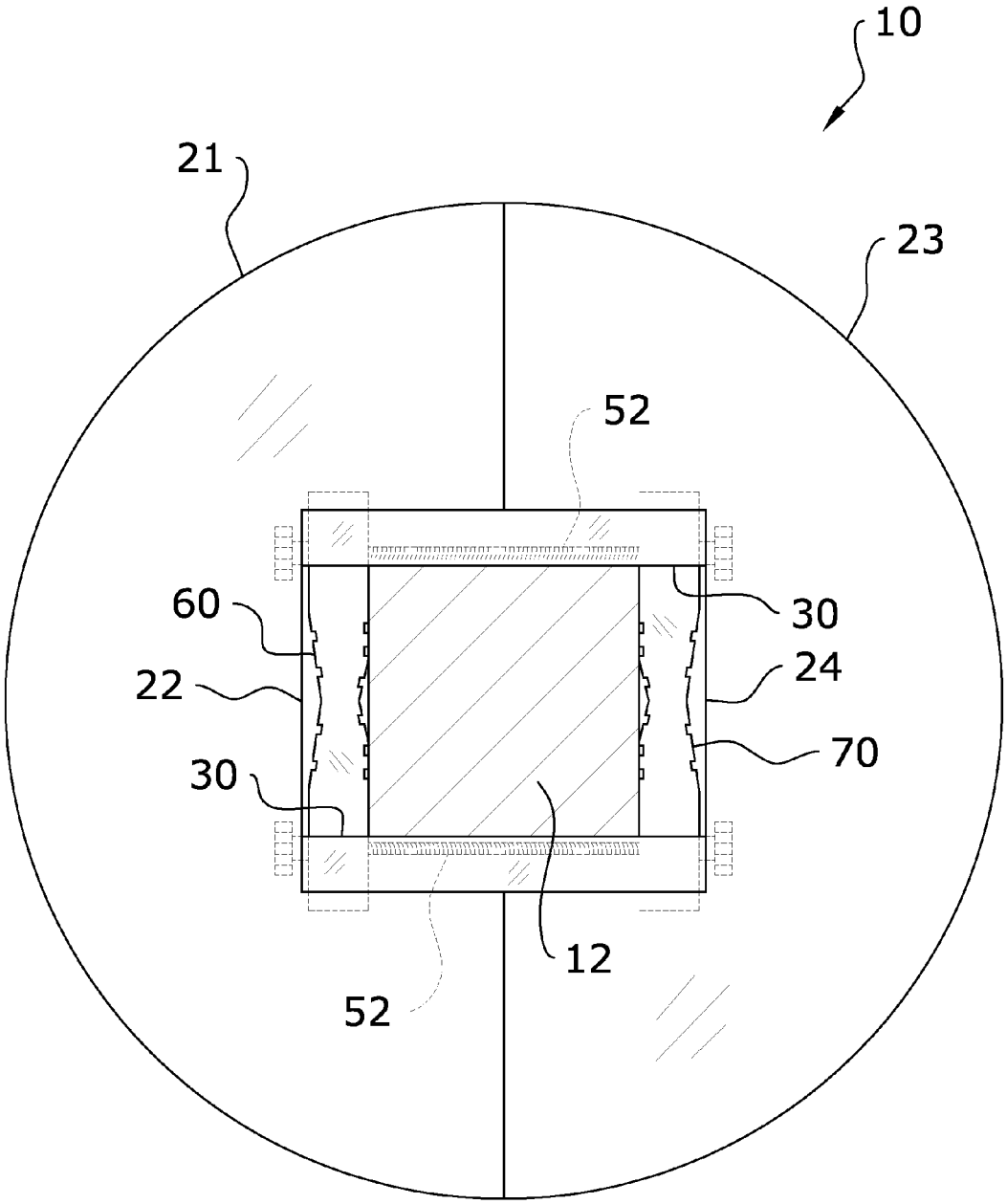
FIG. 7 is a top view of the present invention attached to a vertical support member having a cross-sectional area less than the cross-sectional area of the cutouts and showing two filler members being used.

However, for example, when the vertical support members 12 have a lesser cross-sectional size than the size of the open area defined by the cutouts 22, 24 as illustrated in FIG. 6, filler members 30 may be used to fill gaps formed between the support member 12 and the respective first or second section 21, 23. For example, if the vertical support member is 4 inches×6 inches in cross-sectional size, a first and second filler member 30 may be needed on each side of the vertical support member 12 to fill the 1 inch gap formed, wherein the vertical support member 12 is generally centered in the area defined by the cutouts 22, 24 as illustrated in FIG. 7. In this example, each filler member 30 has a width of approximately 1 inch. However, it is appreciated that wider or narrower filler members may be appreciated. Further, it is appreciated that the shape of the filter members 30 shown in the figures should not be construed as being limited, but instead are merely exemplary illustrations. Various shapes and sizes may be utilized for the filler members 30 of the present invention to suit different applications.

Figure 8:
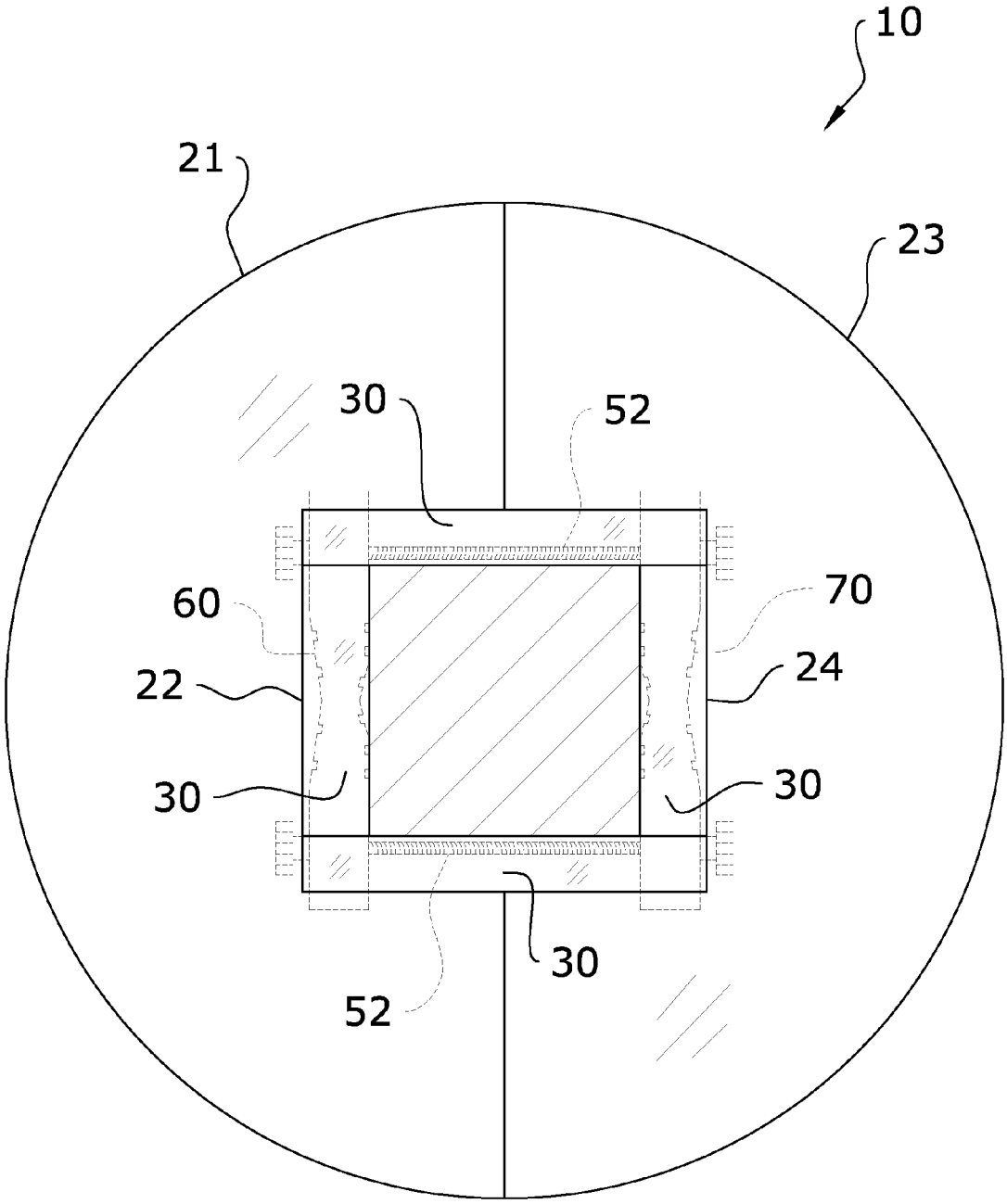
FIG. 8 is a top view of the present invention attached to a vertical support member having a cross-sectional area less than the cross-sectional area of the cutouts and showing four filler members being used.

In another example, if the vertical support member 12 is 4 inches×4 inches in cross-sectional size, a first, second, third, and fourth filler member 30 may be needed, one on each side of the vertical support member 12 to fill the 1 inch gap formed, wherein the vertical support member 12 is generally centered in the area defined by the cutouts 22, 24 as illustrated in FIG. 8. In this example, each filler member 30 has a width of approximately 1 inch. However, it is appreciated that wider or narrower filler members may be appreciated.

Figure 16:
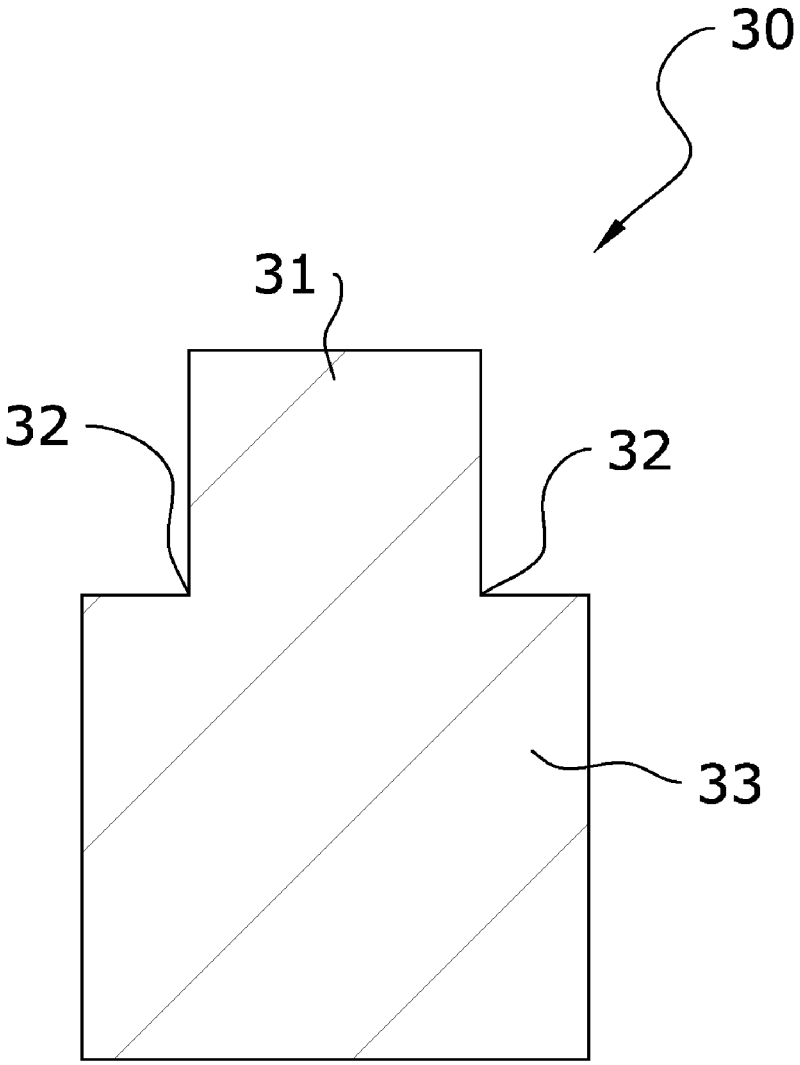
FIG. 16 is a side view of the slatted-filler member.

The filler members generally each include an upper portion 31 and a base portion 33, wherein the upper portion 31 and the base portion 33 are generally integral to comprise an integral filler member 30. The upper portion 31 may be the same size as the base portion 33, such as when the filler member 30 is to resemble a smooth, continuous upper surface as illustrated in FIGS. 7 and 8. Alternately, the upper portion 31 may have notches 32 formed on opposing longitudinal sides such as to resemble spaced-apart slats along the upper surface as illustrated in FIGS. 9 and 16. It is appreciated that each filler member 30 may have a similar structure or may have different shapes, such as for creating patterns upon the upper surface of the tabletop 20.

The base portion 33 of each of the filler members 30 is generally supported in a level manner such that the upper surface of the upper portion 31 is level and flush with the upper surface of the rest of the tabletop 20. In the preferred embodiment the base portion 33 is supported via the upper surface of the respective clamp member(s) 60, 70 of the clamp assembly 50, such as by extending along one of the clamp members 60, 70 or extending across and between clamp members 60, 70. Thus, the height of each filler member 30 is generally equal to the distance from the top of the clamp members 60, 70 to the upper surface of the tabletop 20.

Figure 11:
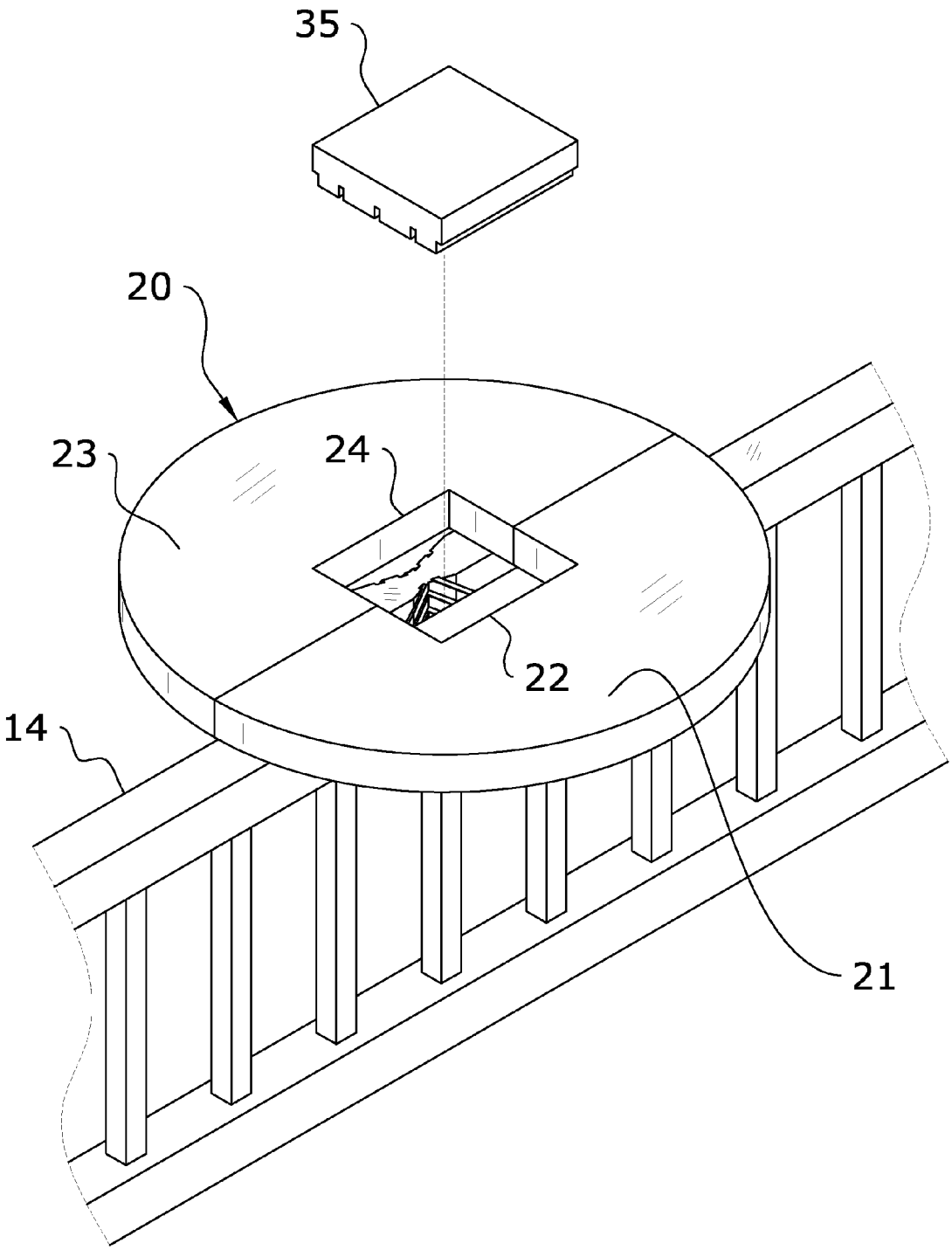
FIG. 11 is an upper perspective view of the present invention attached to a horizontal support member.
Figure 12:
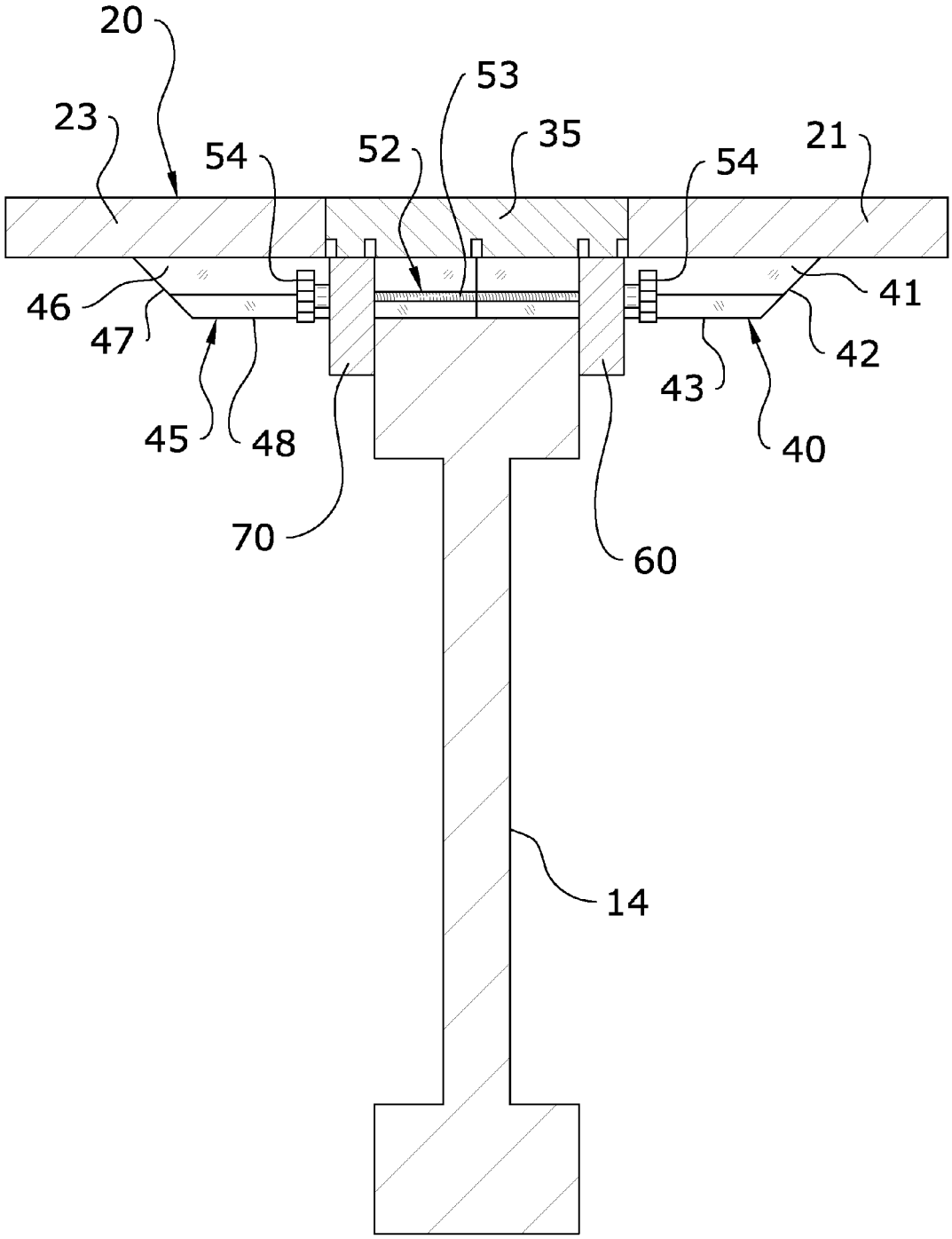
FIG. 12 is a cross-sectional view of the present invention attached to a horizontal support member.
Figure 15:
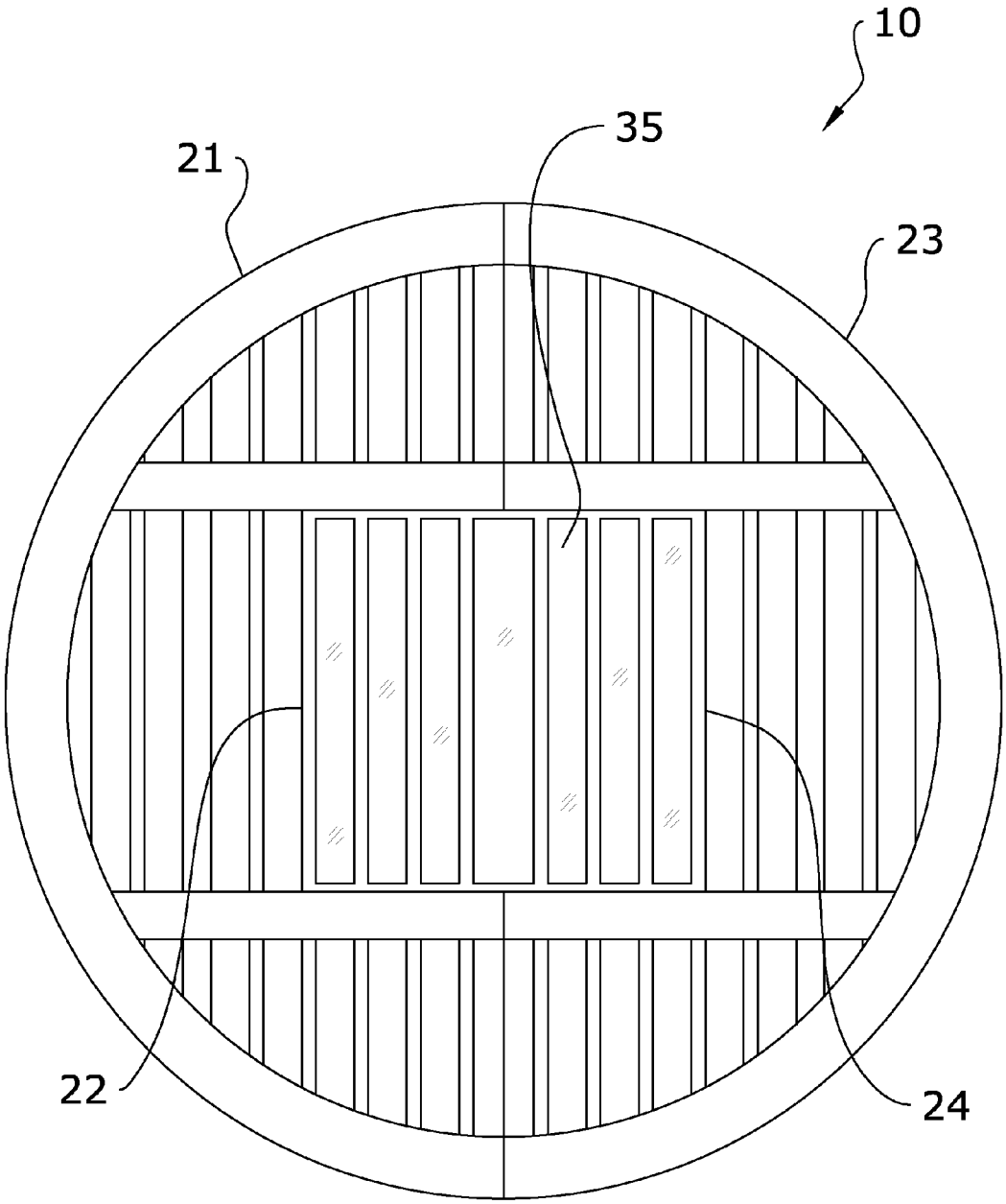
FIG. 15 is a top view of the present invention with the slatted-filler unit.
Figure 17:
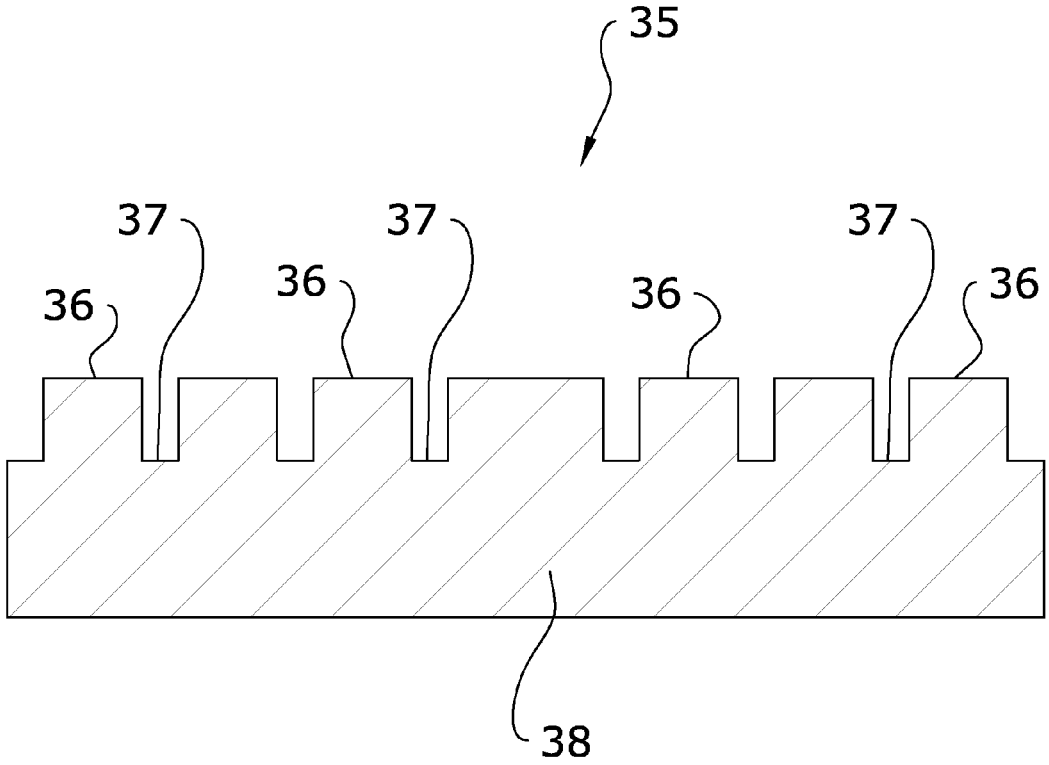
FIG. 17 is a side view of the slatted-filler unit.

Alternately, a filler unit 35 may be used to completely fill the open area defined by the cutouts 22, 24 as illustrated in FIG. 11. The filler unit 35 is useful such as when attaching the tabletop 20 to a horizontal support member 14, such as a deck railing, or when attaching the tabletop 20 to a base assembly 80 to form a side table structure. Like the filler members 30, the filler unit 35 includes an upper portion 36 and a base portion 38, wherein the upper portion 36 and the base portion 38 are generally integral to comprise an integral filler unit 35. The upper portion 36 may be the same size as the base portion 38, such as when the filler unit 35 is to resemble a smooth, continuous upper surface. Alternately, the upper portion 36 may have notches 37 formed in spaced-apart intervals such as to resemble spaced-apart slats along the upper surface as illustrated in FIGS. 15 and 17.

The base portion 38 of the filler unit 35 is generally supported in a level manner such that the upper surface of the upper portion 36 is level and flush with the upper surface of the rest of the tabletop 20. In the preferred embodiment the base portion 38 is supported via the upper surface of the clamp assembly 50 or the horizontal support member 14. Thus, the height of the filler unit 35 is generally equal to the distance from the top of the clamp members 60, 70 or horizontal support member 14 to the upper surface of the tabletop 20.

Figure 3:
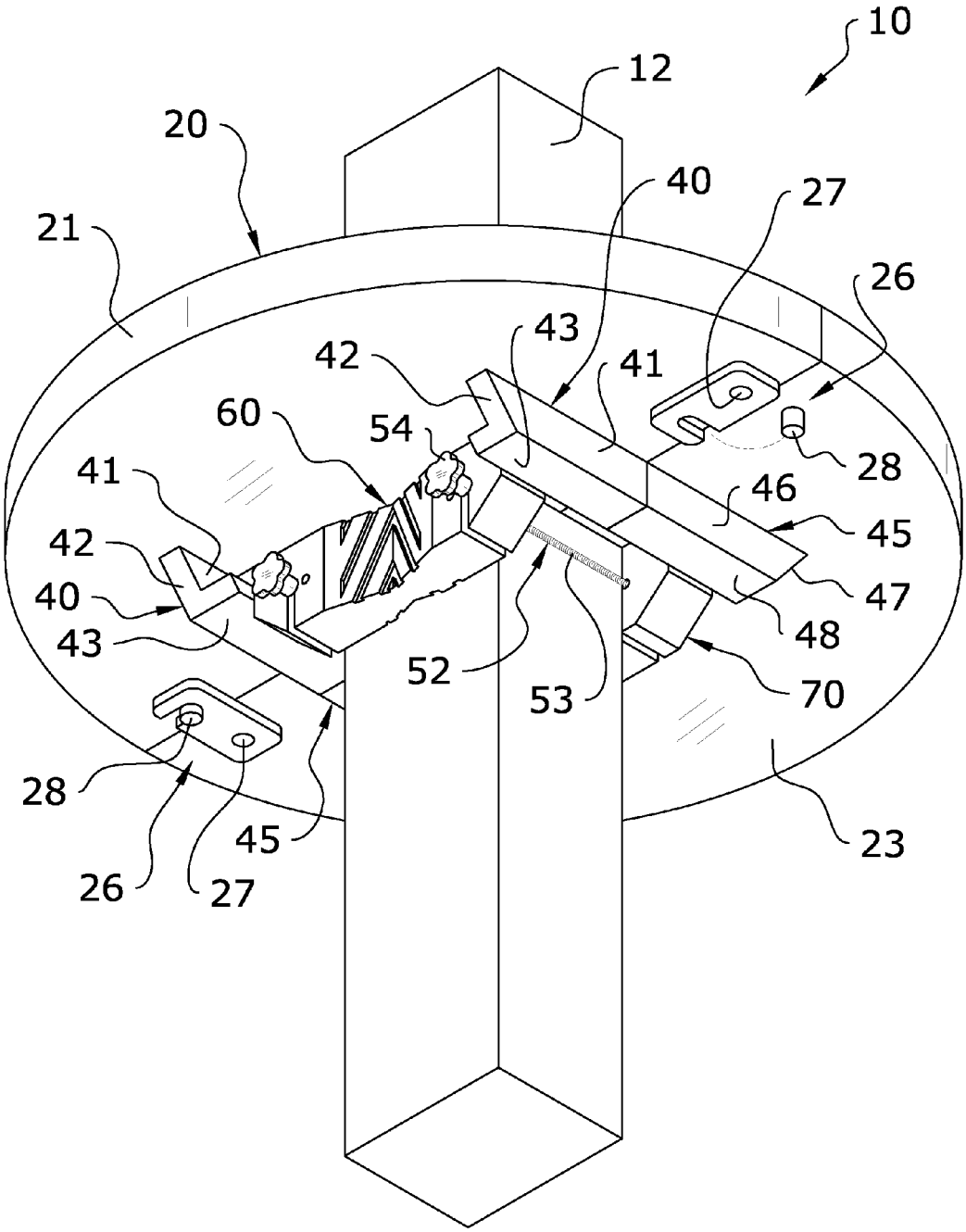
FIG. 3 is a lower perspective view of the present invention attached to the vertical support member.

Each section 21, 23 is also generally attached via one or more latch assemblies 26 as illustrated in FIG. 3. The latch assemblies 26 generally are located along the bottom surface of the sections 21, 23 so as to not be visible. Each latch assembly 26 generally includes an operable mechanism 27 on one of the sections 21, 23 and a catch member 28 on the other section 21, 23, such that when connected the facing edge of each of the sections 21, 23 is positioned firmly against the other and the upper surface of each of the sections 21, 23 are flush.

It is appreciated that various types of latches may be used to detachably secure the first section 21 and the second section 23 together and the latches may be operably pivotal about a horizontal, vertical, or other axis. The structure, shape and size of the latch assemblies 26 shown in the figures are merely exemplary and the scope of the present application should not be so limited, as different structures, shapes and sizes may be utilized for the latch assemblies 26 for different applications of the present invention.

Figure 2:
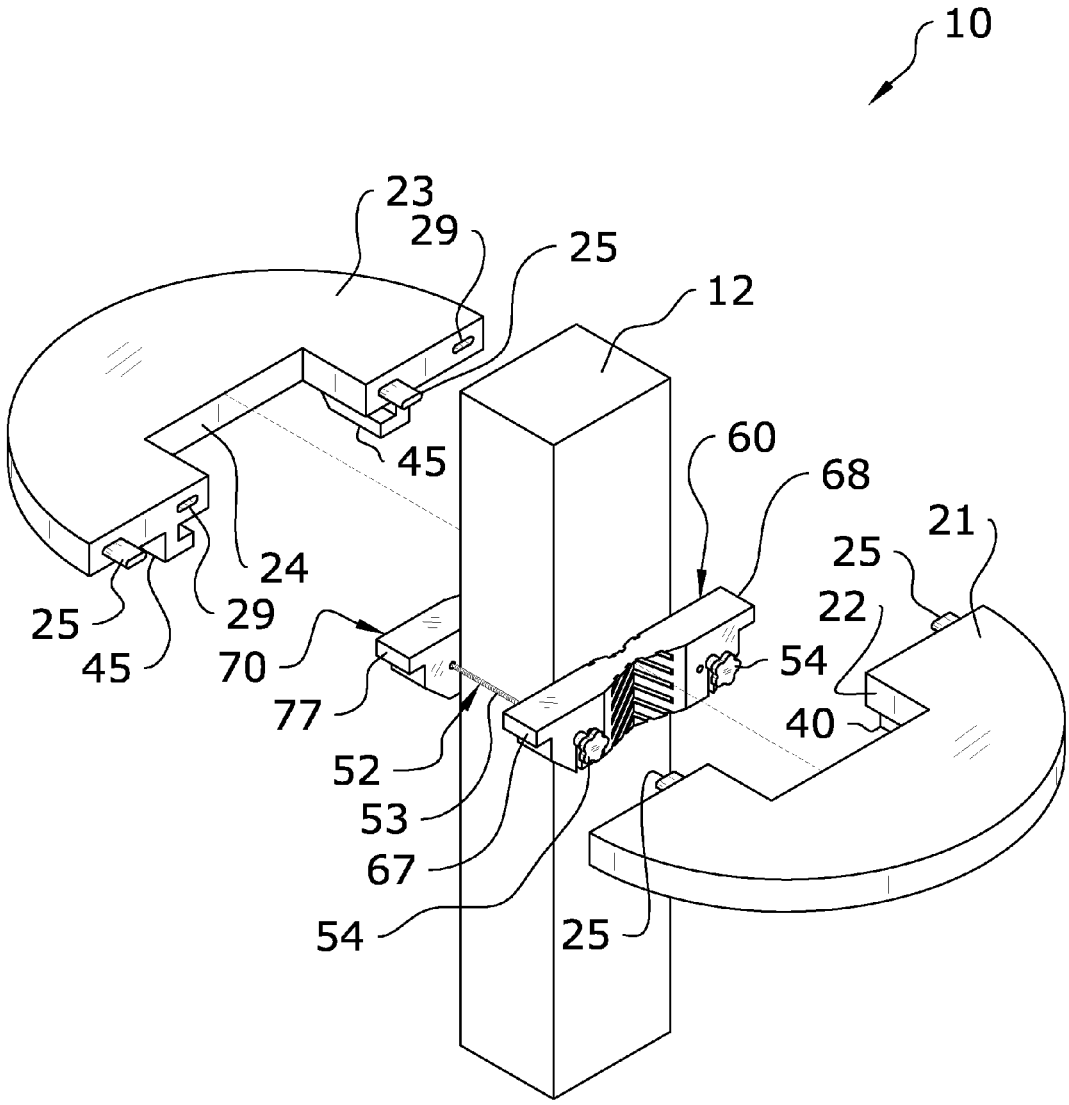
FIG. 2 is an upper perspective view of the clamp assembly attached to the vertical support member and the table sections exploded outwards.

Each section 21, 23 may also generally include one or more slots 25 and tabs 29 to further secure the two sections 21, 23 to each other when so assembled. As shown in FIG. 2, one embodiment of the present invention includes a pair of slots 25 and a pair of tabs 29 positioned on each of the first section 21 and second section 23. The slots 25 and tabs 29 are positioned on the sections 21, 23 such that, when the sections 21, 23 are combined, each tab 29 on one section 21, 23 will slide into a corresponding slot 25 on the other section 21, 23. However, it is appreciated that more or less slots 25 and tabs 29 may be utilized in different embodiments of the present invention.

The tabletop also includes hook members 40, 45 which extend from the lower surface of the tabletop 20 to vertically couple the tabletop 20 to the clamp assembly 50. The hook members 40, 45 are generally each elongated in structure and have a vertical portion 41, 46 which extends to a point below the end extensions 67, 68, 77, 78 of the clamp members 60, 70 and horizontal portions 43, 48 perpendicularly extending inwardly from the horizontal portions 43, 48 to a point below and underneath the end extensions 67, 68, 77, 78 of the clamp members 60, 70 such that the end extensions 67, 68, 77, 78 of the clamp assembly 50 and the hook members 40, 45 couple together. Each of the vertical portions 41, 46 also generally includes angled longitudinal outer ends 42, 47 that correspondingly match the angled longitudinal ends 82 of the legs 81 of the base assembly 80. Each of the vertical portions 41, 46 also include flat inner ends to flushly match with a mating vertical portion 41, 46. Each section 21, 23 include a pair of hook members 40 or 45 as illustrated in FIG. 3.

C. Clamp Assembly.

The clamp assembly 50 is used to retain the tabletop 20 in the preferred orientation, height, and position upon the respective support member 12-14, 87. The clamp assembly 50 is adjustable to accommodate various widths and shape support members 12-14, 87. In the preferred embodiment, the clamp assembly 50 includes a first clamp member 60, a second clamp member 70, and a pair of fastener assemblies 52 to secure the first clamp member 60 and the second clamp member 70 together tightly against the respective support member 12-14, 87. Each fastener assembly 52 is preferably comprised of an elongated bolt 53 and tightening nut generally having a grip knob and referenced as the retaining member 54; however it is appreciated that various other types of fastening assemblies may be utilized to secure together the first and second clamp members 60, 70. The clamp members 60, 70 are preferably comprised of a wood material, however other materials may be appreciated.

Each clamp member 60, 70 is positioned against an opposing side of the support member 12-14, 87 to secure the present invention to a support member 12-14, 87. It is appreciated that the clamp members 60, 70 may be loosened to allow the entire assembly to be adjusted along the support member 12-14, 87 without removal of the tabletop 20.

The clamp members 60, 70 each have a first lengthwise side 61, 71 and an opposite, second lengthwise side 64, 74. The first side 61, 71 includes a first receiver notch 62, 72 and the second side 64, 74 includes a second receiver notch 65, 75. Each receiver notch 62, 72, 65, 75 is generally comprised of a triangular shape. The receiver notches 62, 72, 65, 75 are for receiving circular or irregular-shaped support members, such as a circular pole or a tree trunk.

Figure 4:
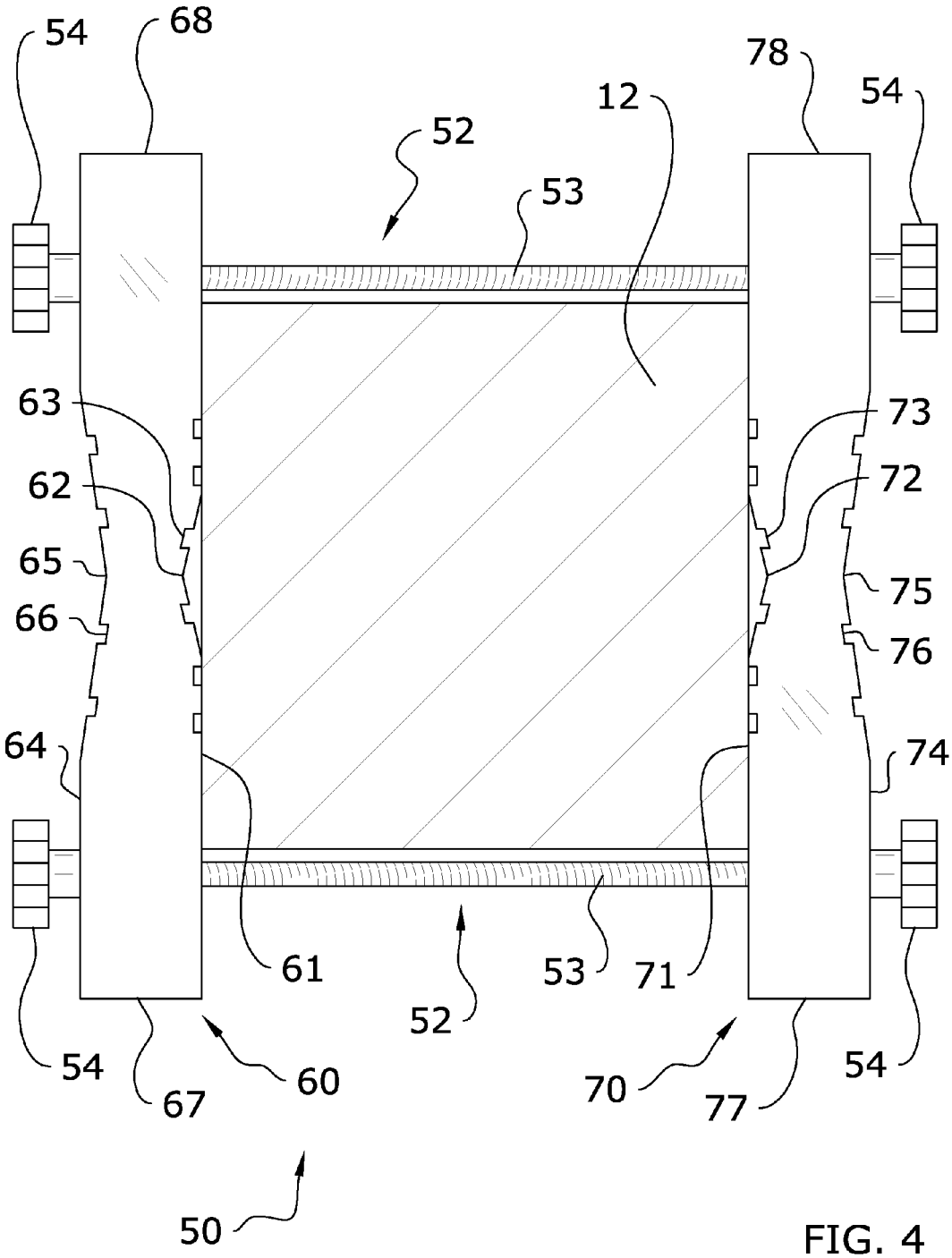
FIG. 4 is a top view of the clamp assembly attached to the vertical support member.
Figure 5:
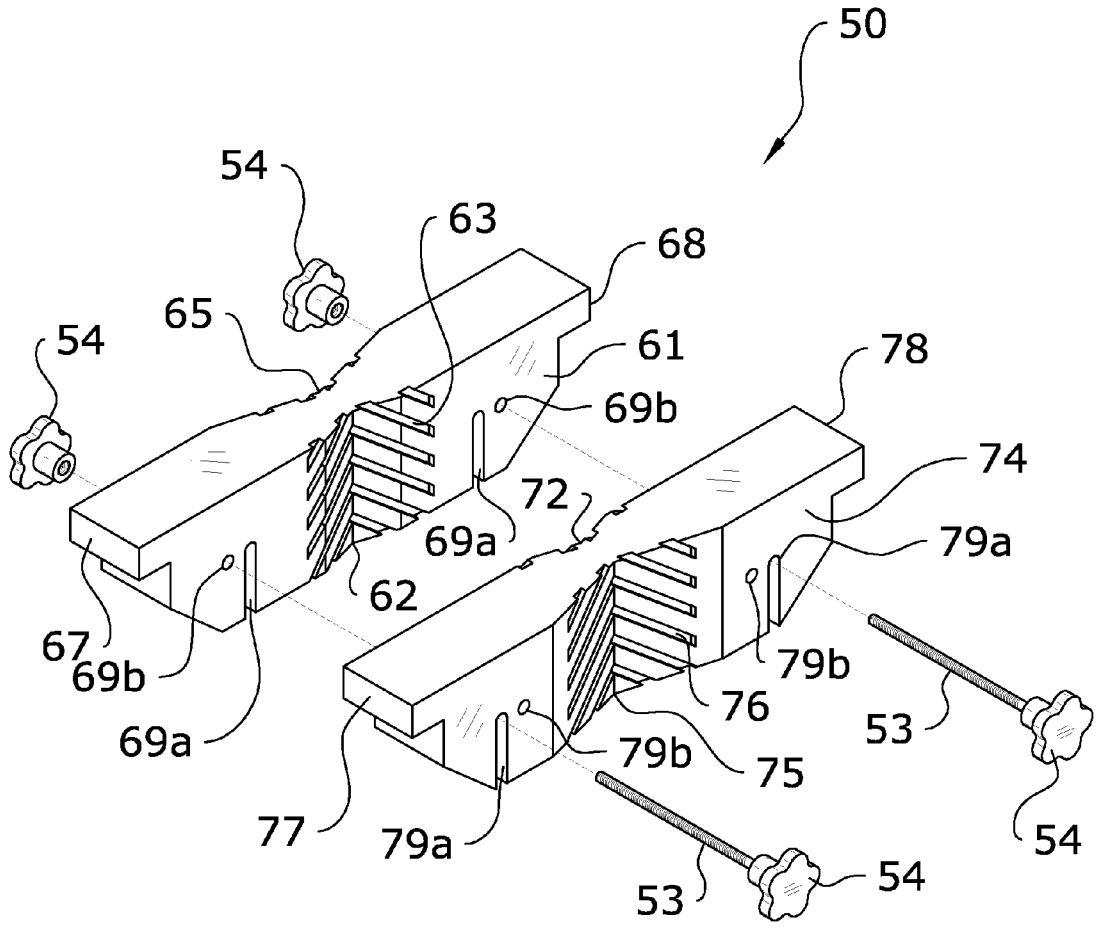
FIG. 5 is an exploded upper perspective view of the clamp assembly.

The first receiver notch 62, 72 is generally much smaller in size than the second receiver notch 65, 75. The first receiver notch 62, 72 is for receiving small-diameter circular or irregular-shaped support members such as an umbrella pole or small tree. The second receiver notch 65, 75 is generally for receiving large to medium diameter circular or irregular-shaped support members. When the clamp member 60, 70 is positioned upon a flat-sided support member, the first side is usually positioned against the respective surface of the support member such that the touching surface of the support member spans across the first receiver notch 62, 72 and engages the planar portion of the first side extending in each opposing direction from the first receiver notch 62, 72 as illustrated in FIGS. 2 and 4.

The clamp members 60, 70 also generally include a plurality of channels 63, 73, 66, 76 extending within the central or contact portion of the first side 61, 71 and second side 64, 74. The channels 63, 73, 66, 76 may be arranged in various patterns, such as but not limited to vertically, angled, in a V-shaped pattern, etc. The channels 63, 73, 66, 76 provide for drainage and increase the fraction of the clamp member 60, 70 upon the support member such as to restrict downward or other movement of the clamp members 60, 70 upon the support member when attached thereto.

As noted earlier, each of the clamp members 60, 70 also include a first end extension 67, 77 and a second end extension 68, 78. The first end extension 67, 77 extends outwardly from the upper portion of the first longitudinal end of the respective clamp member 60, 70 and the second end extension 68, 78 extends outwardly from the upper portion of the second longitudinal end of the respective clamp member 60, 70. As described previously, the end extensions 67, 77, 68, 78 are for receiving the hook members 40, 45 to couple the clamp assembly 50 to the tabletop 20 via the hook members 40, 45.

Each of the clamp members 60, 70 also includes a pair of slots 69*a*, 79*a* open on a bottom end and a pair of openings 69*b*, 70*b*. The slots 69*a*, 79*a* and openings 69*b*, 70*b* are located in opposite arrangements on the clamp members 60, 70, such that for example the first clamp member 60 may include the openings 69*b* on the longitudinal outside of the slots 69*a* with respect to the length of the first clamp member 60 and the second clamp member 70 would then include the slots 79*a* on the longitudinal outside of the openings 79*b* with respect to the length of the second clamp member 70. It is appreciated that a vice versa arrangement may be appreciated. The openings 69*b*, 70*b* are comprised of a circular hole extending through the respective clamp member 60, 70 and the slots 69*a*, 79*a* are comprised of an elongated structure that is open on the bottom to correlate with the bottom of the respective clamp member 60, 70 and closed on the top at a point vertically-level with the opening 69*b*, 79*b*. The reasoning for the arrangement of the openings 69*b*, 70*b* and the slots 69*a*, 79*a* will become apparent during the discussion of the installation of the invention.

The openings 69*b*, 70*b* and slots 69*a*, 79*a* are also generally spaced apart a distance such that the inside openings 69*b* and slots 79*a* are used for narrower support members and the outside openings 79*b* and slots 69*a* are used for wider support members. This ensures that the holding force of the bolts 53 will be as close as possible to the support member thus increasing the strength of the clamp assembly 50.

D. Base Assembly.

Figure 13:
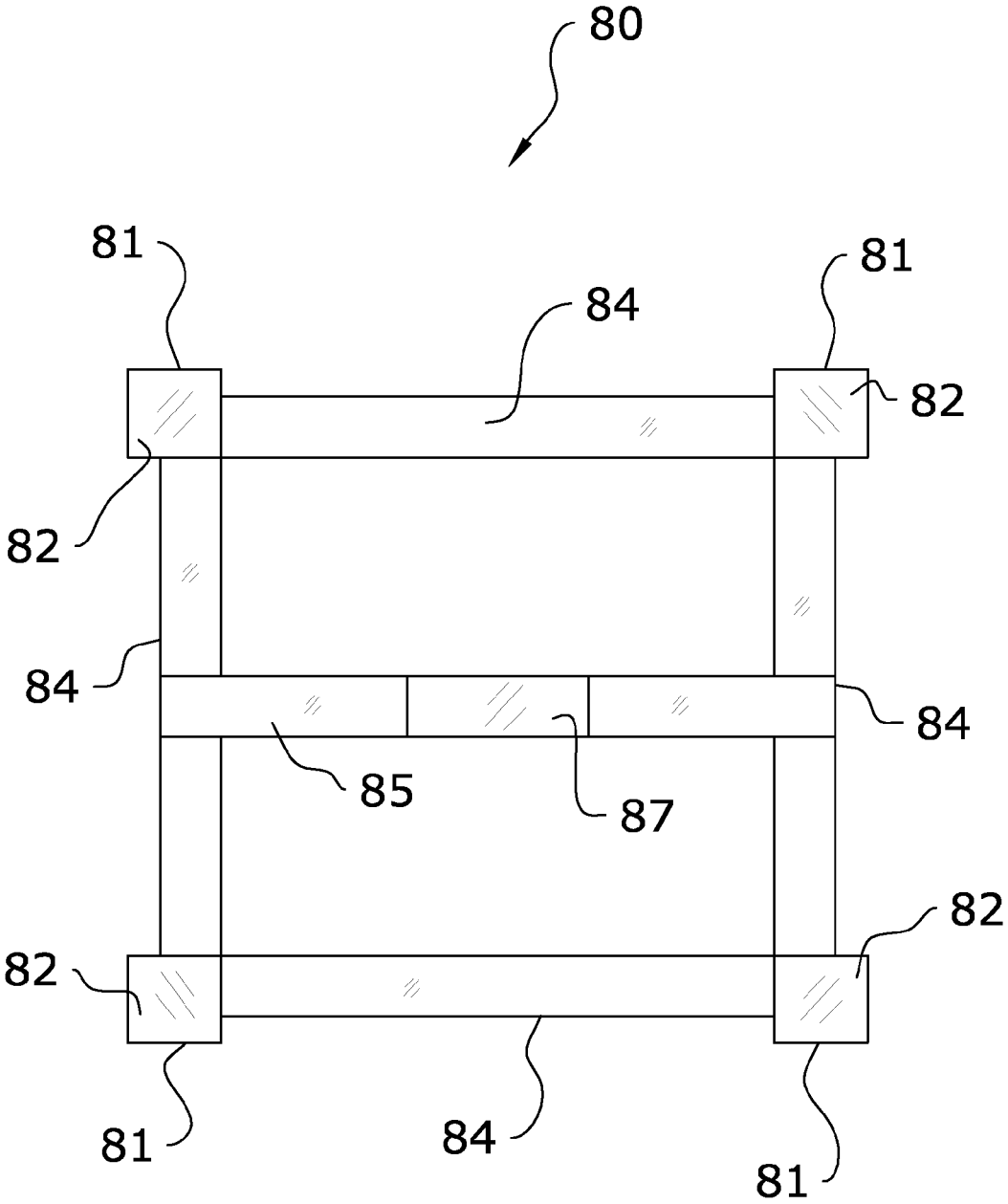
FIG. 13 is a top view of the base assembly.
Figure 14:
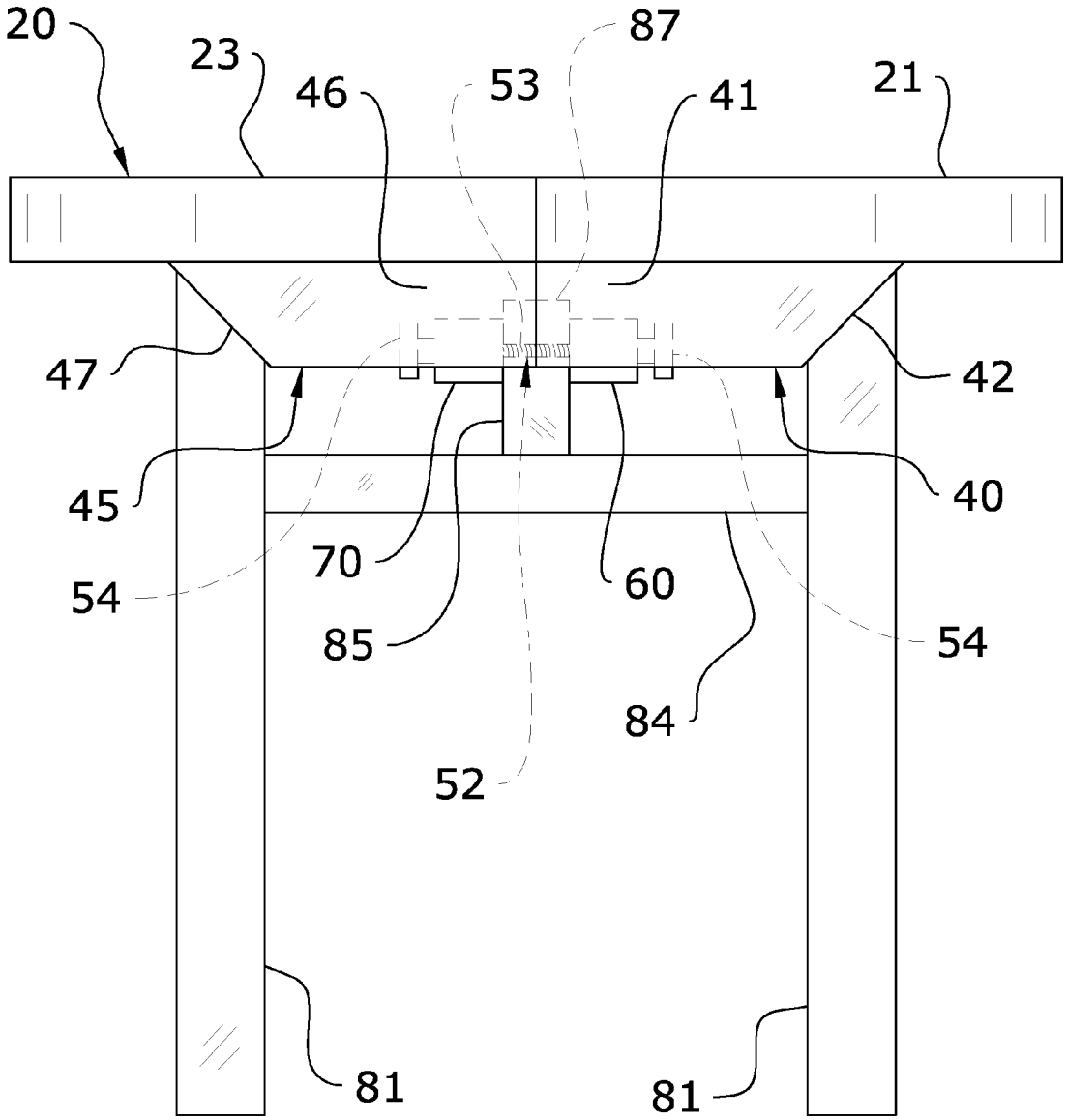
FIG. 14 is a side view of the present invention attached to the base assembly.

The base assembly 80 is an optional component in which the tabletop 20 and clamp assembly 50 are attached to a legged structure such as to form a portable, conventional side table structure as illustrated in FIGS. 13 and 14. In the preferred embodiment, the base assembly 80 includes 4 vertical legs 81 each having a flat bottom end and an angled upper end 82 to match and receive the angled ends 42, 47 of the hook members 40, 45. Each of the legs 81 is connected by peripheral supports 84 to add stability to the base assembly 80. Extending across a pair of the peripheral supports 84 are cross supports 85 which support a vertical support member 87. The vertical support member 87 is generally comprised of a 4 inch×4 inch, 6 inch×6 inch or other structure in which the clamp assembly 50 would attach to. The attachment of the clamp assembly 50 and tabletop 20 is accomplished thus in a similar manner as in the embodiment where the clamp assembly 50 and tabletop 20 attach to the vertical support member 12 or the angled support member 13.

E. Attachment of Present Invention to Vertical or Angled Support Member.

In attachment, the width or horizontal clearance distance of the support member 12, 13 is first assessed such as to determine whether to use the inside openings 69*b* and slots 79*b* or the outside openings 79*b* and slots 69*a*. If the width or horizontal clearance of the support member 12, 13 is less than the inside openings 69*b* and slots 79*b*, the inside openings 69*b* and slots 79*b* are then used. If the width or horizontal clearance of the support member 12, 13 is less than the outside openings 79*b* and slots 69*a* but greater than inside openings 69*b* and slots 79*b*, the outside openings 79*b* and slots 69*a* are used.

For example sake, we will assume the first clamp member 60 has the openings 69*b* that are the appropriate distance apart. Thus, the first clamp member 60 is positioned firmly against one side surface of the support member 12, 13 and the bolts 53 are extended through each of the openings 69*b* of the first clamp member 60 such as to extend past the opposing side surface of the support member 12, 13. The second clamp member 70 is then attached to the bolts 53 with either the first side 71 or the second side 74 facing the support member 12, 13 (generally using the same respective side 71, 74 as the side 61, 64 of the first clamp member 60 that was used) and wherein the bolts 53 are received via the slots 79*a* of the second clamp member 70. Once fully vertically positioned within the slots 79*a* of the second clamp members 60, 70 70, the retaining members 54 may be attached to the bolts 53 and tightened. Before being completely tightened, the clamp assembly 50 is adjusted to the desired vertical position upon the support member 12, 13.

The first section 21 of the tabletop 20 is then coupled to the clamp assembly 50 orienting the first cutout 22 towards the support member 12, 13 and guiding the first hook members 40 towards the end extensions 67, 68 of the first clamp member 60 such that the horizontal portions 43 of the first hook members 40 extend beneath the end extensions 67, 68 of the first clamp member 60. The first section 21 is then oriented to a horizontal position and temporarily rested upon the clamp assembly 50. The second section 23 is then attached in a similar manner on the opposite side of the support member 12, 13 so that the second cutout 24 faces the support member 12, 13 and the second hook members 45 of the second section 23 are coupled to the end extensions 77, 78. Once both of the sections 21, 23 are horizontal and flush with each other, the latch assemblies 26 are operated to pull the first section 21 towards the second section 23 or vice versa thus applying an inward horizontal force which prevents the hook members 40, 45 from being dislodged. At this time, any filler members 30 may be inserted within the first and/or second cutouts 22, 24 24 as needed or desired.

F. Attachment of Present Invention to Horizontal Support Member.

In attachment of the present invention to a horizontal support member 14, the first section 21 and the second section 23 are first attached together via the latch assemblies 26. The clamp assembly 50 is then assembled and slid into position upon the tabletop 20 via the hook members 40, 45 so that the clamp assembly 50 is coupled to the tabletop 20. The distance between the first clamp member 60 and the second clamp member 70 is adjusted so that a separation between the clamp members 60, 70 is greater than the width of the support member 14.

The assembled tabletop 20 and clamp assembly 50 are then positioned over the support member 14 so that the support member 14 fits between the clamp members 60, 70. The clamp members 60, 70 are then moved closer together via adjustment of the fastener assemblies 52 until the clamp members 60, 70 firmly grasp the support member 14. It is appreciated that the hook members 40, 45 extend downwardly past the bolts 53 of the fastener assemblies 52 such as to contact the support member 14 and provide a space between the top of the support member 14 and the bolts 53 to prevent damage to the support member 14 due to engagement with the bolts 53. At this time, any filler members 30 or the filler unit 35 may be inserted within the first and second cutouts 22, 24 as needed or desired.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A legless portable table system, comprising:

a tabletop having an upper surface and a lower surface;

a hook means extending from said lower surface; and a clamping means adapted for removable attachment to a vertical, horizontal, or angled support member, said clamping means being removably coupled to said tabletop via said hook means to support said upper surface of said tabletop in a horizontal orientation, wherein said clamping means comprises:

a first clamp member having a pair of first openings and a pair of first slots;

a second clamp member having a pair of second openings and a pair of second slots, wherein said pair of second openings are located on an inward side of said pair of second openings with respect to a second length of said first clamp member;

a pair of fastening assemblies each including a bolt and a retaining member secured thereon, said bolts either collectively extended through said pair of first openings and said pair of second slots or extended through said pair of second openings and said pair of first slots when attaching said clamping means to the support member.

2. The legless portable table system of claim 1, wherein said tabletop has a first section and a second section, said first section and said second section being substantially similar in size and shape, and said first section and said section being detachable.

3. The legless portable table system of claim 2, wherein said first section has a first cutout and wherein said second section has a second cutout, said first cutout aligns with said second cutout to form a common space.

4. The legless portable table system of claim 3, wherein said common space is centrally located upon said tabletop.

5. The legless portable table system of claim 4, including one or more filler members removably positioned within said common space.

6. The legless portable table system of claim 2, including a latching means having a first connecting means attached to said first section and a second connecting means attached to said second section, said first connecting means removably connects to said second connecting means.

7. The legless portable table system of claim 1, wherein said clamping means comprises, a first clamp member having a first end extension and a second end extension, and a second clamp member having a first end extension and a second end extension, wherein said hook means comprises a pair of first hook members detachably coupled to said first and second end extensions of said first clamp member and wherein said hook means comprises a pair of second hook members detachably coupled to said first and second end extensions of said second clamp member.

8. The legless portable table system of claim 1, wherein said clamping means comprises:

a first clamp member having a first lengthwise side and an opposite, second lengthwise side, said first lengthwise side having a central first receiver notch and said second lengthwise side having a central second receiver notch, wherein said first receiver notch is smaller than said second receiver notch; and a second clamp member having a first lengthwise side and a opposite, second lengthwise side, said first lengthwise side of said second clamp member having a central first receiver notch and said second lengthwise side of said second clamp member having a central second receiver notch, wherein said first receiver notch of said second clamp member is smaller than said second receiver notch of said second clamp member.

9. A portable table system, comprising:

a support member;

a tabletop having an upper surface and a lower surface;

a hook means extending from said lower surface; and a clamping means adapted for removable attachment to said support member, said clamping means being removably coupled to said tabletop via said hook means such as to support said upper surface of said tabletop in a horizontal orientation, wherein said clamping means comprises:

a first clamp member having a pair of first openings and a pair of first slots;

a second clamp member having a pair of second openings and a pair of second slots, wherein said pair of second openings are located on an inward side of said pair of second openings with respect to a second length of said first clamp member;

a pair of fastening assemblies each including a bolt and a retaining member secured thereon, said bolts either collectively extended through said pair of first openings and said pair of second slots or extended through said pair of second openings and said pair of first slots when attaching said clamping means to the support member.

10. The portable table system of claim 9, wherein said tabletop comprises:

a first section having a first cutout; and a second section having a second cutout, said first section and said second section being substantially similar in size and shape and said first section and said second section being adapted for removable attachment to each other;

wherein said first cutout and said second cutout collectively receive said support member such that said support member extends through said first cutout and said second cutout and said support member is centrally located with respect to said tabletop.

11. The portable table system of claim 10, including one or more filler members removably positioned within said first cutout and/or said second cutout between said support member and said first section and/or said second section, said one or more filler members having an upper surface, said upper surface being flush with said tabletop.

12. The legless portable table system of claim 9, wherein said clamping means comprises, a first clamp member having a first end extension and a second end extension, and a second clamp member having a first end extension and a second end extension, wherein said hook means comprises a pair of first hook members detachably coupled to said first and second end extensions of said first clamp member and wherein said hook means comprises a pair of second hook members detachably coupled to said first and second end extensions of said second clamp member.

13. The legless portable table system of claim 9, wherein said clamping means comprises:

a first clamp member having a first lengthwise side and an opposite, second lengthwise side, said first lengthwise side having a central first receiver notch and said second lengthwise side having a central second receiver notch, wherein said first receiver notch is smaller than said second receiver notch;

wherein one of either said first lengthwise side or said second lengthwise side receives a first side of said support member such as to permit insertion of said first side of said support member in one of either said first receiver notch or said second receiver notch; and a second clamp member having a first lengthwise side and a opposite, second lengthwise side, said first lengthwise side of said second clamp member having a central first receiver notch and said second lengthwise side of said second clamp member having a central second receiver notch, wherein said first receiver notch of said second clamp member is smaller than said second receiver notch of said second clamp member.

wherein one of either said first lengthwise side of said second clamp member or said second lengthwise side of said second clamp member receives a second side of said support member such as to permit insertion of said second side of said support member in one of either said first receiver notch of said second clamp member or said second receiver notch of said second clamp member.

14. The portable table system of claim 9, wherein said support member is comprised of a vertically oriented structure.

15. The portable table system of claim 9, wherein said support member is comprised of an angled structure.

16. The portable table system of claim 9, wherein said support member is comprised of a horizontally-oriented structure.

17. The portable table system of claim 9, wherein said support member is comprised of a vertically oriented structure and wherein said support member is attached to a base assembly, said base assembly having a plurality of legs.

18. A legless portable table system, comprising:

a tabletop having a first section and a second section, said first section having a first upper surface, a first lower surface, and a first cutout, and said second section having a second upper surface, a second lower surface, and a second cutout;

wherein said first upper surface aligns with said second upper surface, wherein said first section and said second section are substantially similar in size and shape, wherein said first section and said second section are each adapted for removable attachment to each other, and wherein said first cutout and said second cutout align to form a common space centrally located upon said tabletop;

a pair of first hook members extending from said first lower surface of said first section;

a pair of second hook members extending from said second lower surface of said second section; and a clamping assembly having a first clamp member, a second clamp member, and a pair of fastening assemblies, said first clamp member and said second clamp member each having a first end extension and a second end extension;

wherein said first clamp member and second clamp member removably attach around a support member via said pair of fastening assemblies; wherein said first hook members couple to said first and second end extensions of said first clamp member and wherein said second hook members couple to said first and second end extensions of said second clamp member to removably coupled said tabletop to said clamping assembly via said first and second hook members such as to support said first and second upper surface of said tabletop in a horizontal orientation, and wherein the first hook members are detachably coupled to said first and second end extensions of said first clamp member and wherein the second hook members are detachably coupled to said first and second end extensions of said second clamp member.

* * * * *